United States Patent [19]

Forgey

[11] 4,142,649

[45] Mar. 6, 1979

[54] DISPENSING APPARATUS FOR TAMPONS

[75] Inventor: James F. Forgey, Houston, Tex.

[73] Assignee: Seth Pomeroy, Denver, Colo.

[21] Appl. No.: 876,230

[22] Filed: Feb. 9, 1978

Related U.S. Application Data

[63] Continuation of Ser. No. 746,481, Dec. 1, 1976, abandoned.

[51] Int. Cl.[2] ..... B65D 83/02

[52] U.S. Cl. ..... 221/82; 222/97; 312/97.1

[58] Field of Search ..... 221/90, 82, 97, 102, 221/113, 120, 122, 283, 287, 89, 303, 306, 307, 310, 86; 222/557; 312/97.1, 135, 284, 285; 206/379, 380, 539; 220/23.83, 23.86; 211/49 D, 76, 88

[56] References Cited

U.S. PATENT DOCUMENTS

| | | | |
|---|---|---|---|
| 2,176,232 | 10/1939 | Warren et al. | 221/283 X |
| 2,907,502 | 10/1959 | Lang | 222/557 |
| 3,378,134 | 4/1968 | Wilkinson et al. | 312/97.1 |
| 3,527,383 | 9/1970 | Borsum et al. | 221/122 X |
| 3,593,882 | 7/1971 | Rhindress | 221/113 X |
| 3,733,112 | 5/1973 | Marquardt | 312/97.1 |

*Primary Examiner*—Allen N. Knowles
*Assistant Examiner*—Fred A. Silverberg
*Attorney, Agent, or Firm*—Sheridan, Ross, Fields & McIntosh

[57] ABSTRACT

Apparatus for dispensing cylindrical packages, such as tampons, having a carrousel provided with a magazine for storage of a reserve supply of tampons and a plurality of open-ended hollow dispensing compartments adapted to each hold a single article to be dispensed. The carrousel is mounted for rotation within a housing which housing is provided with a manually operable dispenser capable of discharging by gravity the contents of a compartment aligned with the dispenser. A knob is attached to a shaft formed at the bottom of the carrousel for rotating the carrousel about its axis of rotation and detents facilitate aligning the dispensing compartments with the dispenser. The housing is provided with a cover so that the interior of the dispensing apparatus is concealed from view when the cover is in place. A receptacle for powder, for example, with a lid is incorporated in the cover.

3 Claims, 4 Drawing Figures

DISPENSING APPARATUS FOR TAMPONS

This is a continuation of application Ser. No. 746,481, filed Dec. 1, 1976, now abandoned.

BACKGROUND OF THE INVENTION

1. Field of the Invention

This invention is in the field of apparatus for dispensing cylindrical objects such as tampons wherein a plurality of dispensing compartments each of which is adapted to hold one object to be dispensed are mounted on a carrousel which carrousel is mounted for manual rotation within a housing. Dispensing means of the housing when aligned with a dispensing compartment permit the gravitational discharge of the object stored in the aligned dispensing compartment from the housing. A removable top or cover for the housing facilitates reloading the dispensing compartments from a magazine for objects to be dispensed which magazine is formed as an integral part of the carrousel.

2. Description of the Prior Art

The prior art relating to article dispensing apparatus known to the inventor broadly disclose rotating carrousels having a plurality of dispensing compartments adapted to hold one or more of the items to be dispensed and dispensing means which when aligned with a compartment will under certain conditions discharge an object stored in a dispensing compartment. However, the prior art dispensing apparatus are also vending machines which will discharge such an object only after an appropriate amount of money has been inserted into it. As a consequence the prior art apparatus are provided with complex mechanisms to control the dispensing or vending of objects and include means for preventing unauthorized persons from removing coins from such machines or the objects to be dispensed. Such prior art machines because of cost, size, weight and appearance are not appropriate for use in the home where the problems to be solved are to provide an aesthetically attractive dispenser which can store the contents of a package of tampons, can dispense them one at a time, can be conveniently located in the home, is easy to use, is reliable, and the cost to manufacture of which is relatively low.

SUMMARY OF THE INVENTION

The present invention provides a dispenser for tampons which is adapted for home use. Within an aesthetically attractive housing a carrousel is mounted for rotation. The carrousel is provided with a plurality of dispensing compartments mounted around the periphery of the carrousel. Each of the compartments is adapted to hold a packaged tampon. The interior of the carrousel provides a convenient place for storing additional tampons. A delivery opening is located in the housing and is positioned so that each of the dispensing compartments can in turn be placed in vertical alignment with the opening. A manually operable hatch, or trap door, normally closes or blocks the opening but can be moved aside manually to permit the contents of an aligned compartment to fall through the delivery opening. The carrousel is manually rotatable to align a dispensing compartment with the delivery opening. The housing is provided with a removable top or cover which can be removed to load tampons into the dispensing compartments and/or to store additional tampons in the magazine of the carrousel.

It is, therefore, an object of this invention to provide a dispenser for tampons which is suitable for use in the home.

It is still another object of this invention to provide a dispenser for tampons that is aesthetically attractive and can be easily installed at a convenient location in the home.

It is a further object of this invention to provide a dispenser that is economical to produce, that is easy to use, and is reliable in operation.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the invention, and in which.

DESCRIPTION OF THE PREFERRED EMBODIMENT

Figure 1:
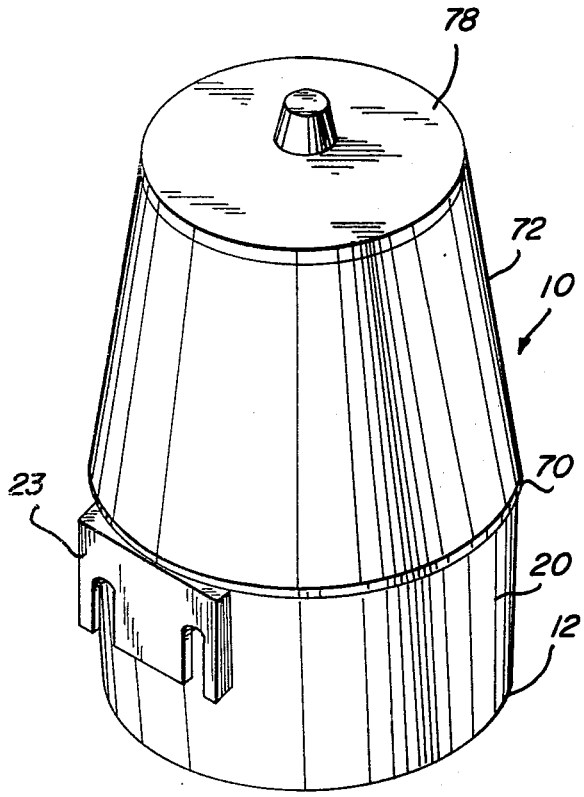
FIG. 1 is a perspective view of the present invention illustrating the various features thereof.
Figure 2:
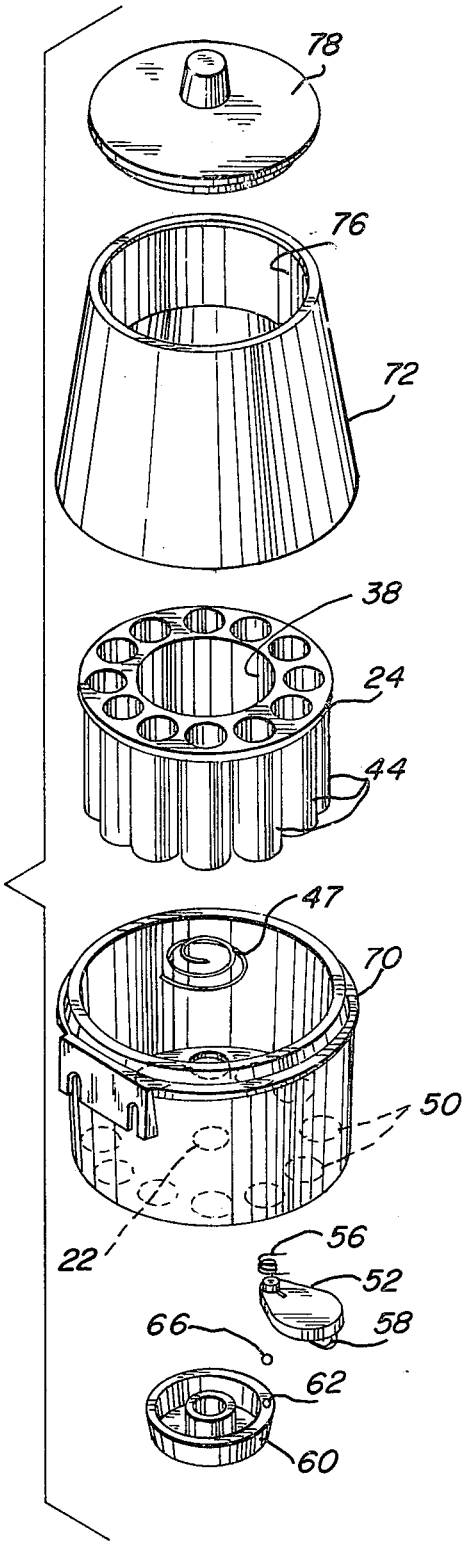
FIG. 2 is an exploded view of the present invention.
Figure 3:
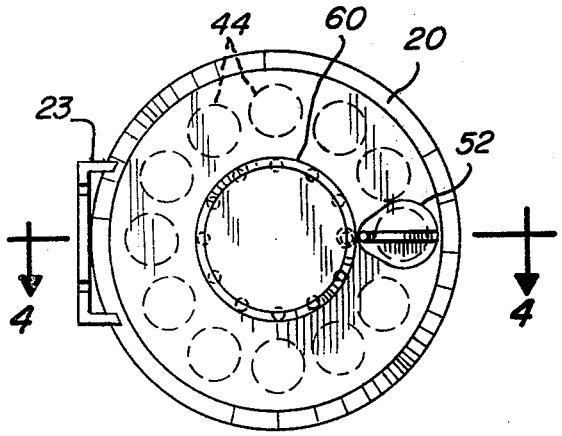
FIG. 3 is a bottom view of the dispensing apparatus of FIG. 1.
Figure 4:
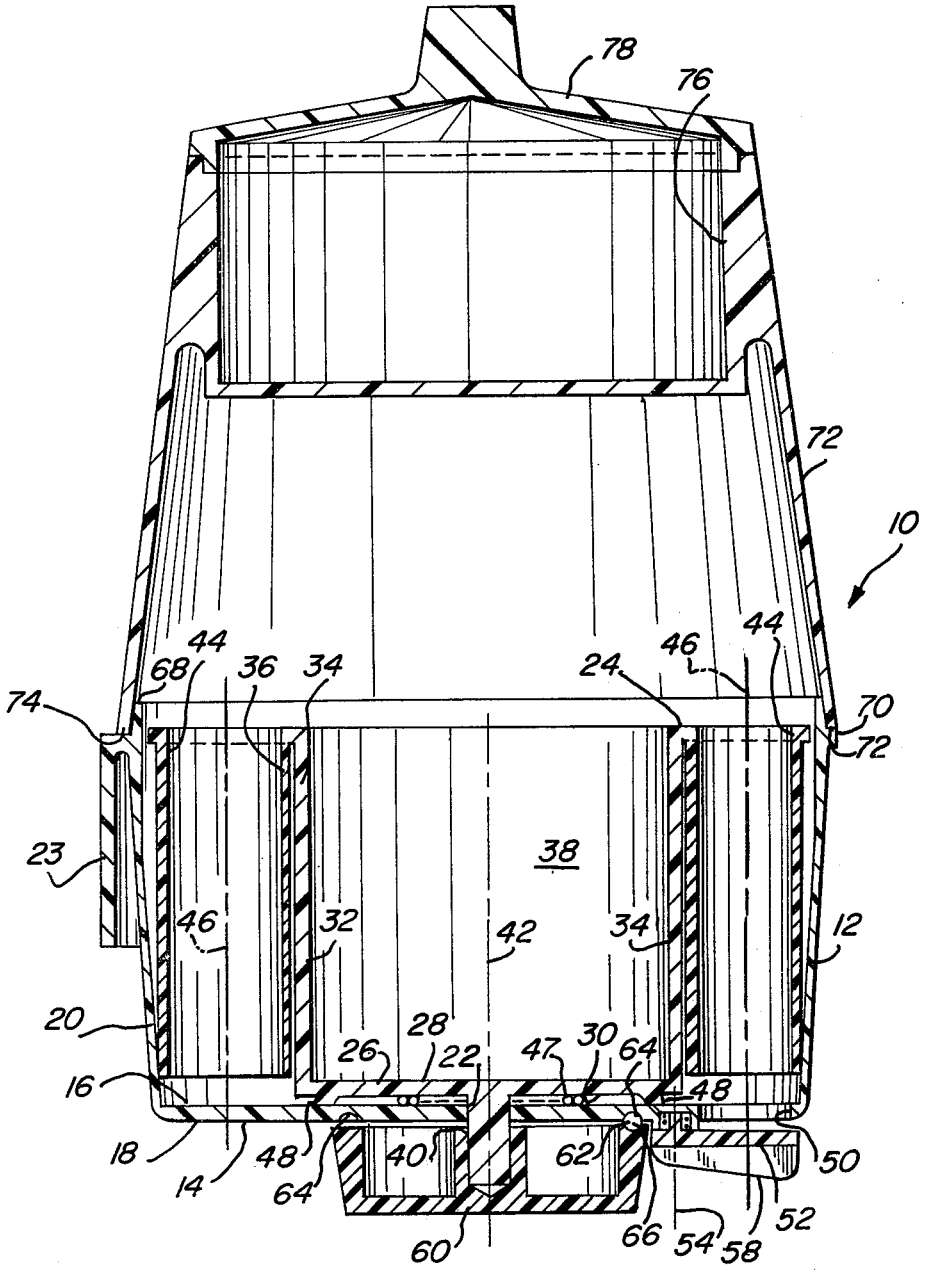
FIG. 4 is an enlarged sectional view taken on line 4—4 of FIG. 3.

Dispensing apparatus, or dispenser, 10 includes a hollow conical housing 12. Housing 12 has a circular bottom wall 14 having an upper substantially planar surface 16 and a lower planar surface 18. Side wall 20 of housing 12 is formed integrally with the outer edge or circumference of bottom wall 14 and diverges or slopes outwardly in an upwardly direction as is best illustrated in FIG. 4. A circular opening 22 is formed substantially in the center of bottom wall 14. Housing 12 is provided with a bracket 23 to facilitate mounting the housing 12 on a vertical wall which is not illustrated.

Carrousel 24 has a substantially circular base plate 26 having a top surface 28 and a bottom surface 30. A circular side wall 32 which has an inner surface 34 and an outer surface 36 is formed integrally with plate 26. The inner surface 34 of side wall 32 and the top surface 28 of base plate 26 define a storage space or magazine 38 in which to store a reserve supply of the articles to be dispensed, individually packaged conventional feminine hygienic tampons, in the preferred embodiment which tampons are not illustrated. Shaft 40 is preferably made integral with base plate 26 and has a longitudinal axis 42 which passes through the center of base plate 26. Shaft 40 projects downwardly from bottom surface 30 of plate 26 as is best illustrated in FIG. 4.

Hollow cylindrical dispensing tubes, or compartments 44 each of which has substantially the same dimensions each has an axis of symmetry 46. The height of each compartment 44 is substantially greater than its width as is best illustrated in FIG. 4. Each of the compartments 44 is fixedly secured to carrousel 24 so that its axis of symmetry is substantially parallel to the longitudinal axis 42 of shaft 40 and each such axis 46 is substantially equidistant from axis 42. The compartments 44 are uniformly distributed around the perimeter of carrousel 24. The top and bottom of each of the dispensing compartments 44 is open or unobstructed.

As can best be seen in FIG. 4, carrousel 24 is positioned within housing 12 with shaft 40 journaled for rotation about its axis 42 within opening 22 in the bottom wall 14 of housing 12 so that axis 42 is also the axis of rotation of carrousel 24. A part of shaft 40 projects below or beyond the lower surface 18 of wall 12. To minimize friction a spring washer 47 is positioned around shaft 40 between base plate 26 of carrousel 24 and the bottom wall 14 of housing 12. A plurality of projections 48, at least 3, are formed on the bottom surface 30 of base plate 26 and are spaced uniformly around the perimeter of base plate 26 substantially equidistant from axis 42. The function of projections 48 is to minimize any tendency of axis 42 of shaft 40 to deviate from being normal to the bottom wall 14 of housing 12 which would increase the frictional forces between shaft 40 and the sides of opening 22.

A dispensing, or delivery, opening 50 is formed in the bottom wall 14 of housing 12. The size of opening 50 is such that the contents of a dispensing compartment 44 aligned with it can easily fall through delivery opening 50. In the preferred embodiment opening 50 is circular and has a diameter substantially equal to that of the circular opening of each of the dispensing compartments 44. Hatch, or trap door, 52 is mounted on bottom wall 14 of housing 12 to pivot about pivot axis 54. Hatch 52 has two positions, a first in which it blocks or closes delivery opening 50, and a second in which it unblocks opening 50 and an object to be dispensed from a dispensing compartment 44 aligned with delivery opening 50 can then fall through opening 50 as a result of the force of gravity acting on the object to be dispensed. A spring 56 biases hatch 52 to its first position where it blocks delivery opening 50. Hatch 52 is provided with a rib 58 which facilitates manually moving hatch 52 from its first to its second positions.

Knob 60 is attached to shaft 40 so that carrousel 24 can be rotated about its axis of rotation 42 by manually twisting or turning knob 60. Knob 60 has a substantially hemispherical recess 62 formed in the surface which opposes the bottom wall 14 of housing 12. A plurality of cooperating substantially hemispherical recesses 64, one for each dispensing compartment 44, are formed in the lower surface 18 of bottom wall 14 of housing 12. A substantially spherical ball 66 is mounted in the recess 62 formed in knob 60. The distance between axis 42 and recess 64 and 62, as is seen in FIG. 4, are substantially equal so that ball 66 will partially enter each recess 64 when aligned with such a recess. The location of the recess 62 and 64 are such that when ball 66 enters any given recess 64 the dispensing compartment 44 corresponding to that recess 64 is aligned with delivery opening 50. Thus when ball 66 enters a recess 64 it signals the user that a compartment 44 is aligned with delivery opening 50.

The upper perimeter 68 of housing 12 is provided with a circumferential shoulder 70. A top, or cover, 72 is adapted to be removably mounted on housing 12 with the bottom surface 74 of top 72 engaging the upper surface of shoulder 70. A receptacle 76 is formed in top 72 for powder or any other appropriate toiletries. A removable lid 78 is provided for receptacle 76 of cover 72.

In the preferred embodiment the major components of dispenser 10 such as housing 12, carrousel 24, compartments 44, hatch 52, knob 60, cover 72 and lid 78 are formed of a suitable plastic material to minimize the cost of materials and the cost of fabrication. The number of dispensing compartments 44 is 12 which are uniformly spaced around the perimeter of carrousel 24. Magazine 38 can hold up to 36 tampons. Thus, the contents of a conventional box of tampons, forty, can be placed in dispenser 10. Housing 12, cover 72 and lid 78 are arranged to provide an aesthetically attractive appearance.

In use, housing 12 is preferably mounted on a vertical wall at any location which is convenient to the user. It is desirable that the axis of rotation 42 be substantially vertical, but a reasonably close approximation to vertical is acceptable. To load dispensing compartments 44, top 72 is removed and one tampon is placed in each of the compartments 44. Additional tampons can be stored in magazine 38. Top 72 is then replaced and when in place as illustrated in FIG. 4 conceals from view the interior of housing 12 as well as carrousel 24. When a tampon is to be dispensed, knob 60 is turned until ball 66 enters into one of the recesses 64 in housing 12 which signals that a dispensing compartment 44 is aligned with delivery opening 50. When this occurs hatch 52 can be pivoted to its second position which when done permits the tampon in the dispensing compartment aligned with delivery opening 50 to fall through opening 50. Subsequent rotation of knob 60 until ball 66 enters the next recess 64 will align the next dispensing compartment 44 with delivery opening 50. When all the compartments 44 of carrousel 24 are empty, they can be refilled by tampons stored in magazine 38 or from another package of same.

From the foregoing it is clear that the dispensing apparatus of my invention is suitable for use in a home and that it is aesthetically attractive and adapted to be easily installed in any convenient location. Further the dispensing apparatus of my invention provides a dispenser that is economical to produce, is easy to use, and is reliable in operation.

It should be evident that various modifications can be made to the described embodiment without departing from the scope of the present invention.

What is claimed is:

1. A dispenser for sequentially dispensing cylindrical elongate tampons, said dispenser comprising:

a housing having a circular bottom wall with a delivery opening therein, and a side wall extending upwardly from the peripheral edge of said bottom wall and having a cylindrical cross-section;

a carrousel rotatably mounted within said housing, said carrousel including:

a cylindrical magazine having a circular base plate and a cylindrical side wall extending upwardly from said base plate to form a central storage area within said magazine for storing a supply of the tampons;

a plurality of dispensing tubes attached to and spaced around the outside of said side wall of said magazine, each of said tubes having an open top and an open bottom and being dimensioned to receive one of the tampons in an upright position, the bottom of each of saib tubes becoming selectively aligned with said delivery opening upon rotation of said carrousel within said housing so that the tampons within said tubes are selectively dispensed through said delivery opening in said bottom wall of said housing;

means exterior to said housing connected to said carrousel for rotating said carrousel to bring said tubes selectively into alignment with said delivery opening;

a hatch connected to said bottom wall of said housing and movable between a first position covering said delivery opening to prevent discharge of said tampons from said dispensing tubes, and a second position uncovering said delivery opening to permit discharge of said tampon from said dispensing tubes; and a cover for said housing to protect the tampons in the magazine and the dispensing tubes, said cover including:

a side wall of substantial height and of cylindrical cross-section having a lower edge engageable with the upper edges of said side wall of said housing;

a receptacle formed within said side wall of said cover for containing powder or other toiletries; and a lid on said receptacle forming a top for said cover.

2. A dispenser, as claimed in claim 1, wherein:

said housing is conical in shape, opening upward; and said cover is conical in shape, opening downward.

3. A dispenser, as claimed in claim 1, wherein:

said receptacle is formed integrally with said side wall of said cover.

* * * * *